US009063558B2

(12) United States Patent
Fukumura

(10) Patent No.: US 9,063,558 B2
(45) Date of Patent: Jun. 23, 2015

(54) CURRENT LIMITING CIRCUIT CONFIGURED TO LIMIT OUTPUT CURRENT OF DRIVER CIRCUIT

(75) Inventor: Keiji Fukumura, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 336 days.

(21) Appl. No.: 13/578,595

(22) PCT Filed: Jan. 19, 2011

(86) PCT No.: PCT/JP2011/051376
§ 371 (c)(1),
(2), (4) Date: Aug. 10, 2012

(87) PCT Pub. No.: WO2011/102189
PCT Pub. Date: Aug. 25, 2011

(65) Prior Publication Data

US 2012/0313609 A1 Dec. 13, 2012

(30) Foreign Application Priority Data

Feb. 17, 2010 (JP) ..... 2010-032631

(51) Int. Cl.
*G05F 1/10* (2006.01)
*G05F 1/573* (2006.01)

(52) U.S. Cl.
CPC ..... *G05F 1/573* (2013.01)

(58) Field of Classification Search
CPC ..... G05F 1/10; G05F 1/573
USPC ..... 323/277, 281, 282, 284, 285; 361/58, 361/93.1, 93.7
See application file for complete search history.

(56) References Cited

U.S. PATENT DOCUMENTS 6,717,787 B2 * 4/2004 Barker ..... 361/93.7
2005/0264970 A1 12/2005 Shinobu

FOREIGN PATENT DOCUMENTS

| | | |
|---|---|---|
| JP | 2004-188682 | 7/2004 |
| JP | 3589392 | 11/2004 |
| JP | 2005-339355 | 12/2005 |
| JP | 2010-74874 | 4/2010 |
| JP | 2010-200550 | 9/2010 |

OTHER PUBLICATIONS

International Search Report Issued Mar. 8, 2011 in PCT/JP2011/051376 Filed on Jan. 19, 2011.

* cited by examiner

*Primary Examiner* — Adolf Berhane
*Assistant Examiner* — Yemane Mehari
(74) *Attorney, Agent, or Firm* — Copper & Dunham LLP

(57) ABSTRACT

A current limiting circuit includes a limit current setting unit that sets a value of a limit current for limiting an output current from a driver circuit connected to the current limiting circuit, the limit current value including a first acceptable value and a second acceptable value larger than the first acceptable value; an excess current detecting unit that detects when the output current from the driver circuit exceeds the first acceptable value; and a limit current adjusting unit that replaces the first acceptable value with the second acceptable value in a period when the output current detected by the excess current detecting unit exceeds the first acceptable value.

3 Claims, 8 Drawing Sheets

Prior Art

Prior Art

CURRENT LIMITING CIRCUIT CONFIGURED TO LIMIT OUTPUT CURRENT OF DRIVER CIRCUIT

TECHNICAL FIELD

The present invention relates to a current limiting circuit for an apparatus for driving a load.

BACKGROUND ART

In a system in which an external apparatus, such as a portable music player or a digital camera, is connected to a host apparatus, such as a personal computer or a car navigation apparatus, the external apparatus may be supplied with electric power from the host apparatus via a connector. Normally, a power switch IC with a protection function is provided immediately upstream of the connector in order to protect a power supply of the host apparatus from any abnormality in the external apparatus. For example, in case the power supply line of the external apparatus connected to the host apparatus is short-circuited to ground (GND), the host apparatus limits the current supply to a constant current of 600 mA, using the power switch IC. At the same time, error information is sent to the host apparatus system. In this case, an average current that can be supplied to a normal external apparatus may be 500 mA at maximum in accordance with a standard specification.

FIG. 1 is a circuit diagram of a driver circuit and a current limiting circuit in a host apparatus according to related art. Specifically, the circuits include a driver circuit 201, an inverter circuit, and an operational amplifier 202. The driver circuit 201 includes a sense resistor and a N-ch (channel) power MOSFET QO. The operational amplifier 202 is connected to the gate of N-channel transistor Q1, and the drain of the N-channel transistor Q1 is connected to a charge pump circuit 50 that produces a voltage (such as 8 V) exceeding a power supply voltage.

FIG. 2 illustrates operation waveforms at various parts of the circuits of FIG. 1. $V_{R1}$ is set to limit an output current when it exceeds 600 mA. When a load is connected that requires a current flow of 900 mA from an output OUT in a period between t1 and t4, an output current $I_{OUT}$ starts increasing at time t1 and a sense voltage $V_{SENS}$ decreases. When the output current $I_{OUT}$ reaches 600 mA at t2, the sense voltage $V_{SENS}$ decreases to $V_{R1}$, at which the operational amplifier 202 is operated, so that an output $V_{N2}$ of the operational amplifier 202 (at node N2) rises. While $V_G$ decreases when $V_{N2}$ rises, the fall of $V_G$ is gradual because of a large transistor width and a large gate capacity of the power MOSFET Q0. In the period of decrease of $V_G$, the output current $I_{OUT}$ of 900 mA flows, and the sense voltage $V_{SENS}$ is lower than $V_{R1}$.

As VG further decreases, the output current IouT approaches 600 mA and the sense voltage $V_{SENS}$ approaches $V_{R1}$ at which $V_{N2}$ decreases. At t3, $V_G$ is constant at a voltage (=6V in the illustrated example of FIG. 2) such that the output current $I_{OUT}$ becomes constant (600 mA). At the same time, $V_{N2}$ is constant (at 1V in the illustrated example) so that $V_G$=6V. At t4, the output current $I_{OUT}$ becomes zero, when the sense voltage $V_{SENS}$ returns to 5V and $V_{N2}$ reaches zero. Thereafter, $V_G$ rises slowly depending on the capacity of the charge pump 50.

In the waveform chart of FIG. 2, the time between t1 and t3 is a response time of the current limiting circuit. The response time may be on the order of 20 μs. The circuits illustrated in FIGS. 1 and 2 form an over-current protection circuit that supplies a load current of up to 500 mA. The over-current protection circuit is configured to lower $V_G$ in about 20 μs when a current limit value (such as 600 mA) is exceeded.

In some external apparatuses, large currents, such as 1 A, may flow during operation in a transient manner. When such an external apparatus is connected, the host apparatus may be required not to limit the current by the power switch IC even if the output current exceeds 500 mA as long as the excess is instantaneous. This is because the external apparatus that requires an instantaneous current flow of 1 A would not be able to operate normally if the load current is limited at 600 mA. Thus, the current limit value of the power switch IC may be set at a higher value, such as 1.2 A. However, in this case, if a current of 900 mA flows in the external apparatus due to abnormality, the host apparatus fails to limit the current and does not even recognize an error. As a result, the large current may keep flowing through the external apparatus, potentially causing the external apparatus to be overheated or even ignited.

JP Patent No. 3589392 discusses an over-current detection/protection circuit in which a current limit value is switched to a higher value for a period immediately after turning on a power MOSFET, where the current limiting value is brought back to a lower value when an inrush current has subsided. In this over-current detection/protection circuit, the over-current detection value is increased only immediately after the turning-on of the power MOSFET so that the inrush current can be allowed to flow. However, if a large current flows instantaneously due to an operation of the external apparatus after its operation current has stabilized, the large current is detected as an over-current. As a result, the output current is limited and the external apparatus fails to operate normally.

SUMMARY OF INVENTION

Thus, it is a general object of the present invention to overcome the disadvantages of the related art. A more specific object of the present invention is to provide a current limiting circuit that does not recognize as abnormal a transient current that should be permitted.

In one embodiment, a current limiting circuit includes a limit current setting unit that sets a value of a limit current for limiting an output current from a driver circuit connected to the current limiting circuit, the limit current value including a first acceptable value and a second acceptable value larger than the first acceptable value; an excess current detecting unit that detects when the output current from the driver circuit exceeds the first acceptable value; and a limit current adjusting unit that replaces the first acceptable value with the second acceptable value in a period when the output current detected by the excess current detecting unit exceeds the first acceptable value.

In another embodiment, a current limiting circuit includes a driver circuit including a power MOSFET and a sense resistor through which a current that flows through the power MOSFET flows; a first current limiting unit that detects an output current of the driver circuit by comparing a sense voltage obtained from one end of the sense resistor with a first reference voltage, and that limits the output current when the output current detected by the first current limiting unit is greater than a first limit current value; a second current limiting unit that detects the output current from the driver circuit by comparing the sense voltage obtained from the one end of the sense resistor with a second reference voltage, and that limits the output current when the output current detected by the second current limiting unit is greater than a second limit current value which is greater than the first limit current value; and an invalidating unit that invalidates an operation of the first current limiting unit for limiting the output current for a period when the output current detected by the first current limiting unit is greater than the first limit current value.

In another embodiment, a current limiting circuit includes a driver circuit including a power MOSFET and a sense resistor through which a current that flows through the power MOSFET flows; a current limiting unit that detects an output current of the driver circuit by comparing a sense voltage obtained from one end of the sense resistor with a first reference voltage, and that limits the output current when the detected output current is greater than a first limit current value; and a limit current value adjusting unit that changes the first reference voltage compared with the sense voltage to a second reference voltage for a period when the output current detected by the current limiting unit is greater than the first limit current value, in order to change the first limit current value to a second limit current value. The first reference voltage and the second reference voltage are set such that the second limit current value is greater than the first limit current value.

BRIEF DESCRIPTION OF THE DRAWINGS

A complete understanding of the present invention may be obtained by reference to the accompanying drawings, when considered in conjunction with the subsequent, detailed description, in which.

BEST MODE OF CARRYING OUT THE INVENTION

First Embodiment

Figure 1:
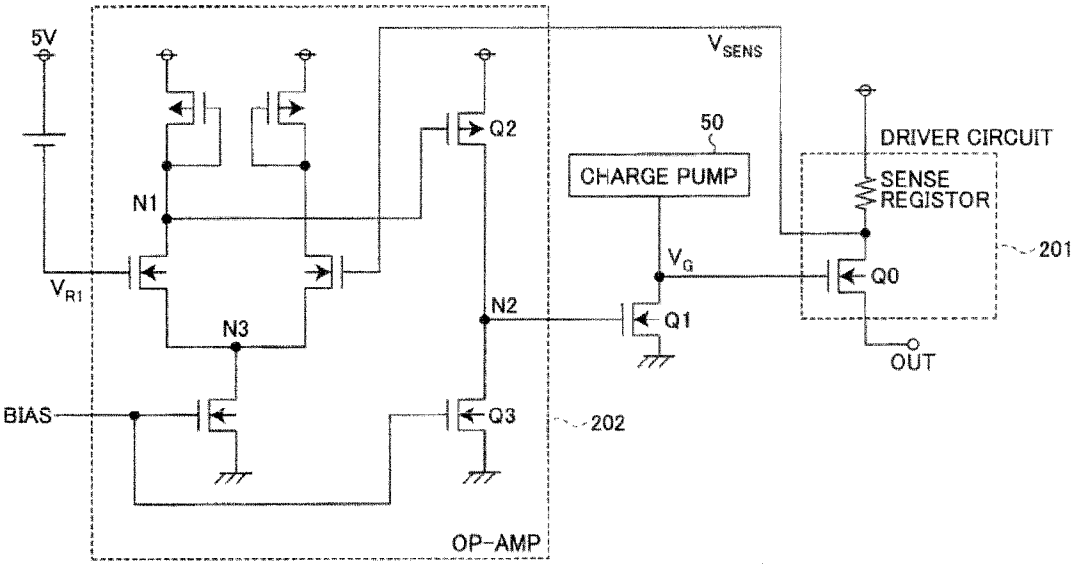
FIG. 1 is a circuit diagram of a driver circuit and a current limiting circuit according to related art.
Figure 2:
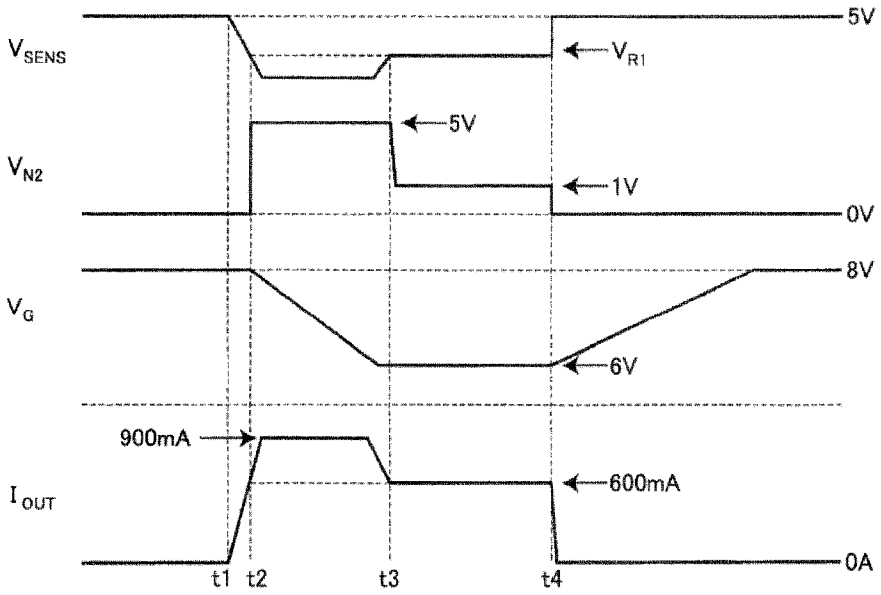
FIG. 2 is a waveform chart for the driver circuit and the current limiting circuit illustrated in FIG. 1.
Figure 3:
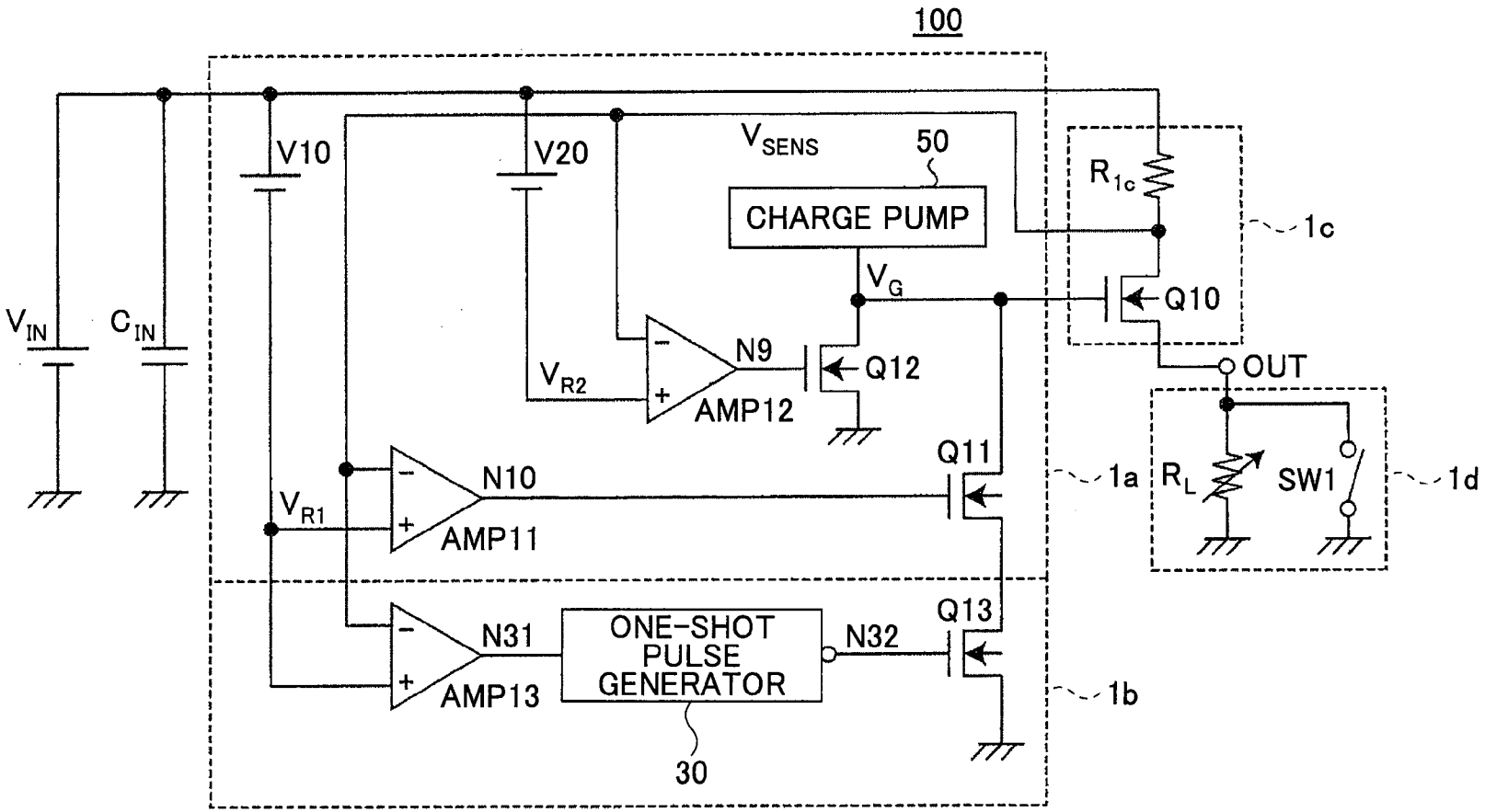
FIG. 3 is a circuit diagram of a current limiting circuit according to a first embodiment of the present invention.

Referring now to the drawings, wherein like reference numerals designate identical or corresponding parts throughout the several views, FIG. 3 is a circuit diagram of a current limiting circuit 100 according to a first embodiment of the present invention. The current limiting circuit 100 includes a current limiting unit 1*a*, a one-shot pulse generating unit 1*b*, and a driver circuit 1*c*. The driver circuit 1*c* includes a sense resistor R1*c* and a power MOSFET Q10 (driver transistor). A power supply voltage $V_{IN}$ is supplied as an input voltage to the driver circuit 1*c*. An external apparatus (load circuit) 1*d* is connected to an output OUT. The external apparatus 1*d* includes equivalent circuits of a variable-load resistor $R_L$ and a switch SW 1 that simulates an abnormality in the external apparatus 1*d*. The driver circuit 1*c* outputs a sense voltage $V_{SENS}$ with reference to the power supply voltage $V_{IN}$.

The current limiting unit 1*a* is configured to limit an output current $I_{OUT}$ at the output OUT based on a comparison of the sense voltage $V_{SENS}$ with reference voltages $V_{R1}$ and $V_{R2}$. The current limiting unit is includes amplifiers AMP 11 and AMP 12 for voltage comparison. The charge pump circuit 50 produces a voltage $V_G$ for driving the power MOSFET Q10. The voltage $V_G$ is set to be greater than the power supply voltage $V_{IN}$. When the sense voltage $V_{SENS}$ is lower than the reference voltages $V_{R1}$ and $V_{R2}$, the voltage $V_G$ is lowered by an operation of transistors Q11 and Q12.

Figure 6:
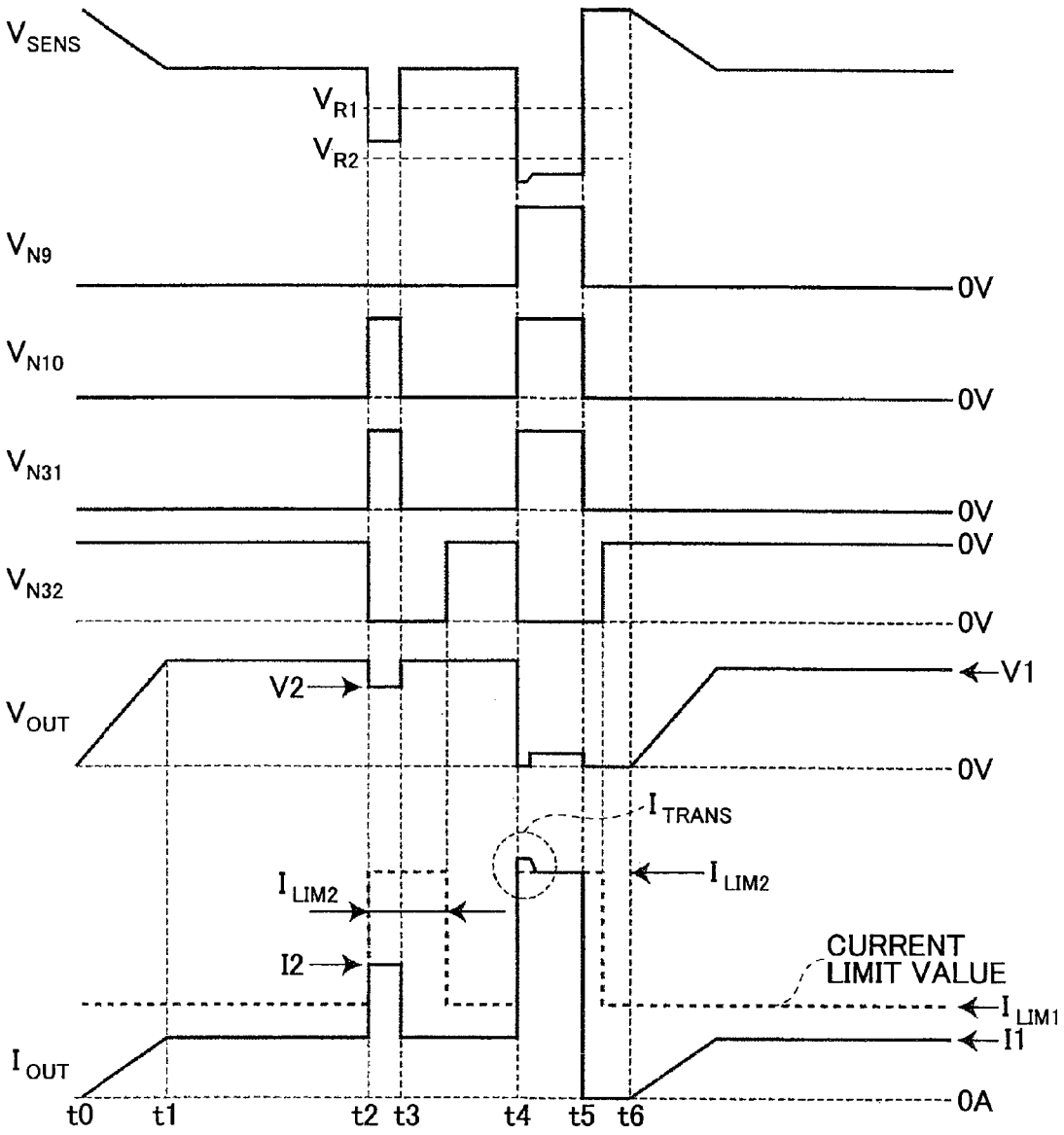
FIG. 6 is a waveform chart for the current limiting circuits according to the embodiments of the present invention.

The reference voltage $V_{R1}$ determines a first limit current $I_{LIM1}$, while the reference voltage $V_{R2}$ determines a second limit current $I_{LIM2}$. $V_{R1}$ and $V_{R2}$ are set such that $V_{IN}-V_{R2}$ is greater than $V_{IN}-V_{R1}$; namely, $I_{LIM2}>I_{LIM2}$. Operation waveforms at various parts of the circuit of FIG. 3 are illustrated in FIG. 6, which also schematically illustrates the relationship between the first limit current and the second limit current $I_{LIM2}$.

The one-shot pulse generating unit 1*b* includes a one-shot pulse generating circuit 30. The one-shot pulse generating circuit 30 generates a pulse having a pulse width "$T_{ILIM2}$" at a rising edge of the output of an amplifier AMP 13 (see FIG. 6). The amplifier AMP 13 is operated to cause the one-shot pulse generating circuit 30 to generate the pulse when the sense voltage $V_{SENS}$ is lower than the reference voltage $V_{R1}$. The one-shot pulse causes the transistor Q13 to be turned off.

The current limiting circuit 100 of FIG. 3 constantly detects whether the output current lour exceeds the first limit current $I_{LIM1}$. The current limiting circuit 100 also detects constantly whether the second limit current $I_{LIM2}$, which is greater than the first limit current $I_{LIM1}$, is exceeded. The current limiting circuit 100 includes a first output current limit unit that limits the output current upon detection of the output current exceeding the first limit current $I_{LIM1}$, and a second output current limit unit that limits the output current upon detection of the output current exceeding the second limit current $I_{LIM2}$. The current limiting circuit 100 further includes an invalidating unit configured to invalidate the limitation of the output current by the first output current limit unit for a period immediately after the detection of the first limit current having been exceeded by the output current $I_{OUT}$. Thus, the output current $I_{OUT}$ is not limited for a period immediately after detection of the output current $I_{OUT}$ exceeding the first limit current value unless the output current $I_{OUT}$ exceeds the second limit current value.

An operation of the current limiting circuit 100 is described with reference to the waveform chart of FIG. 6. At time t0, the current limiting unit 1*a* is enabled by an enable signal (not shown), whereby the power MOSFET Q10 is turned on. The switch SW 1 in the external apparatus 1*d* connected to the output terminal OUT is in an off-state.

The output voltage $V_{OUT}$ then increases and is stabilized at time t1. The increase in the output voltage $V_{OUT}$ is accompanied by an increase in the output current $I_{OUT}$, which is stabilized (I1) at time t1. The sense voltage $V_{SENS}$ is also stabilized at time t1 after decreasing from $V_{IN}$.

When the variable-load resistor $R_L$ of the external apparatus 1*d* is sharply decreased at time t2, the output current $I_{OUT}$ increases to a value I2 and the sense voltage $V_{SENS}$ sharply decreases. If I2 is greater than the first limit current $I_{LIM1}$, i.e., if the sense voltage $V_{SENS}$ is lower than $V_{R1}$, the outputs of the amplifiers AMP 11 and AMP 13 simultaneously assume a high ("H") level, so that the nodes N10 and N31 simultaneously assume "H" levels for a short period. However, the fall of the voltage $V_G$ is gradual because of a large transistor width and a large gate capacity of the power MOSFET Q10. As the voltage $V_G$ starts to change (decrease), the transistor Q13 is soon turned off, so that the voltage $V_G$ hardly changes. In a period "$T_{ILIM2}$" where the transistor Q13 is off, the limit current of the current limiting circuit 100 is set to be equal to the second limit current $I_{LIM2}$ due to the operation of the amplifier AMP 12.

If the output current $I_{OUT}$ decreases from I2 to I1 before the period $T_{ILIM2}$ (pulse width) elapses, the voltage $V_G$ does not change and is maintained at "H" level. When $I_{OUT}$ is at I2, the output voltage $V_{OUT}$ is decreased to V2 due to a voltage drop corresponding to a sum of the on-resistance of the power MOSFET Q10 and the sense resistance times the increase in the output current $I_{OUT}$, as illustrated in FIG. 6.

While not illustrated in FIG. 6, if the period of $T_{ILIM2}$ elapses with the output current $I_{OUT}$ maintained at I2, the transistor Q13 is turned on, so that the output current $I_{OUT}$ is limited to the first limit current $I_{LIM1}$. Thus, the period $T_{ILIM2}$ may be set appropriately depending on the characteristics of the connected external apparatus 1*d*.

When the switch SW 1 of the external apparatus 1*d* is turned on at time t4, the output OUT is short-circuited to ground. This short-circuiting of the switch SW 1 simulates a failure in the external apparatus 1*d*.

When the output current $I_{OUT}$ exceeds the first limit current $I_{LIM1}$, the output of the amplifier AMP 13 assumes "H" level and the limit current is set to the second limit current $I_{LIM2}$. When the output current $I_{OUT}$ exceeds the second limit current $I_{LIM2}$, the output $V_{N9}$ of the amplifier AMP 12 assumes "H" level and the transistor Q12 is turned on, so that the power MOSFET Q10 is feedback-controlled and the output current $I_{OUT}$ is limited to the second limit current $I_{LIM2}$. Simultaneously, error information is sent to the host apparatus system. A transient current $I_{TRANS}$ in excess of the second limit current $I_{LIM2}$ flows for a very short period before the feedback control of the current limiting unit 1*a* is stabilized.

At time t5, the enable signal to the current limiting unit 1*a* is disabled by the operation of the host apparatus system in response to the error information. As a result, the power MOSFET Q10 is turned off and the output current $I_{OUT}$ becomes zero. Thereafter, when the switch SW 1 is turned off before time t6 and the current limiting unit 1*a* is again enabled at time t6, the transistor Q10 is turned on after time t6, so that the output voltage $V_{OUT}$ rises in the same manner as after t0.

Second Embodiment

Figure 4:
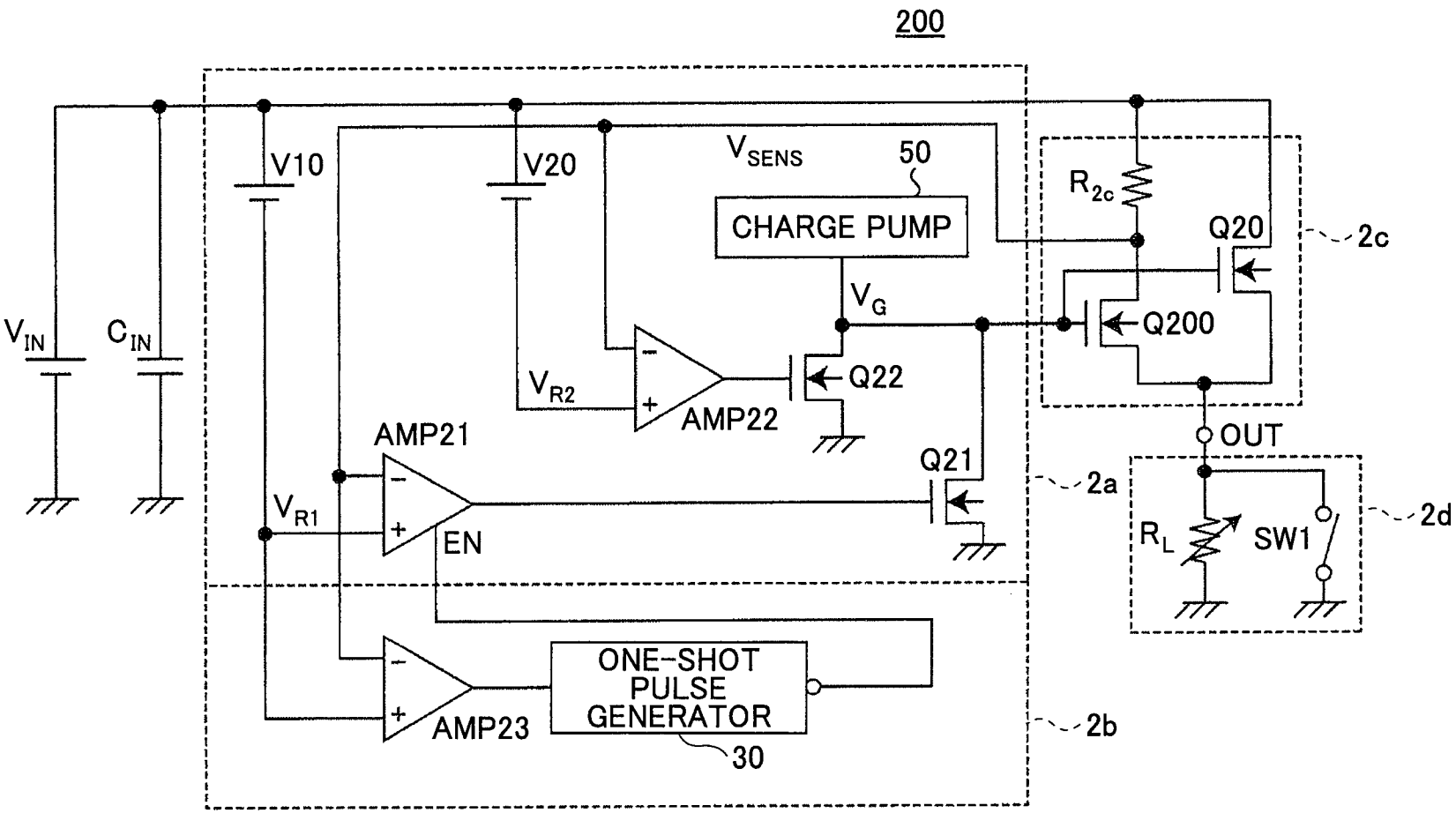
FIG. 4 is a circuit diagram of a current limiting circuit according to a second embodiment of the present invention.

FIG. 4 is a circuit diagram of a current limiting circuit 200 according to a second embodiment of the present invention. The current limiting circuit 200 is generally similar to the current limiting circuit 100 illustrated in FIG. 3. Specifically, the current limiting circuit 200 includes a driver circuit 2*c*, a current limiting unit 2*a*, and a one-shot pulse generating unit 2*b* which are configured to provide substantially identical functions to those of the driver circuit 1*c*, the current limiting unit 1*a*, and the one-shot pulse generating unit 1*b*, respectively, of the current limiting circuit 100.

In the current limiting circuit 200, an output of the one-shot pulse generating unit 2*b* is supplied to an enable terminal EN of the amplifier AMP 21 of the current limiting unit 2*a*. In the case of the one-shot pulse generating unit 1*c* of the foregoing embodiment illustrated in FIG. 3, the one-shot pulse generating circuit 30 generates a one-shot pulse in order to turn off the transistor Q13, thus invalidating the turning-on of the transistor Q11. Similarly, in the current limiting unit 2*a* illustrated in FIG. 4, the amplifier AMP 21 is disabled by a one-shot pulse generated by the one-shot pulse generating circuit 30 so that the output of the amplifier AMP 21 is maintained at "L" level, thereby preventing (invalidating) the turning-on of the transistor Q21.

The operation waveforms of the current limiting circuit 200 are similar to the waveforms for the current limiting circuit 100 illustrated in FIG. 6. The driver circuit 2*c* includes a power MOSFET Q20, a power MOSFET 0200 having a smaller transistor width than the power MOSFET 020, and a sense resistor R2*c*. A current corresponding to a size ratio of the power MOSFET Q20 and the power MOSFET 0200 flows through the sense resistor R2*c*, producing a sense voltage $V_{SENS}$. Thus, the voltage drop by the sense resistor R2*c* in the driver circuit 2*c* can be reduced. The driver circuit 2*c* may be replaced with the driver circuit 1*c* illustrated in FIG. 3.

Third Embodiment

Figure 5:
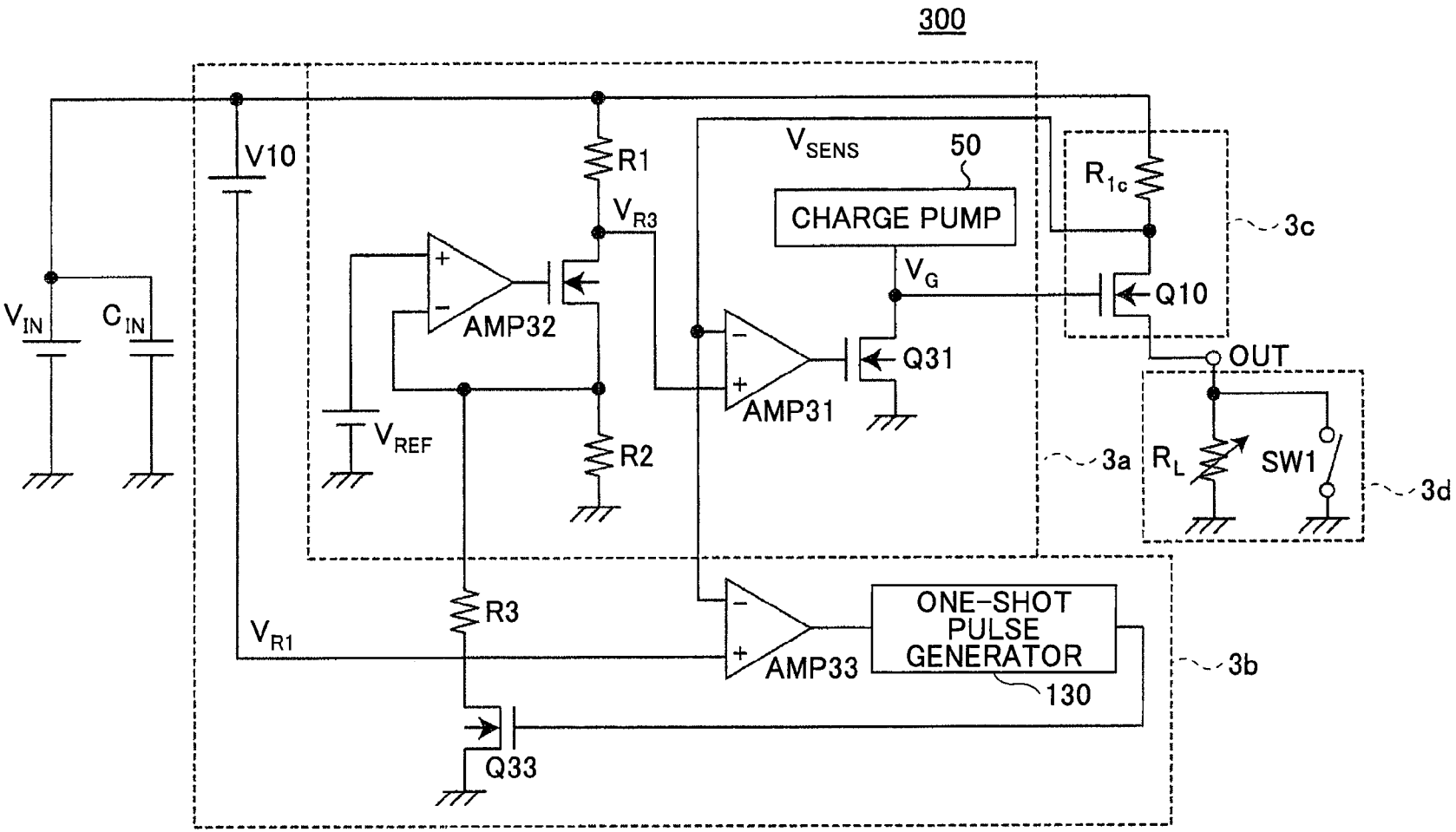
FIG. 5 is a circuit diagram of a current limiting circuit according to a third embodiment of the present invention.

FIG. 5 is a circuit block diagram of a current limiting circuit 300 according to a third embodiment. The current limiting circuit 300 is also generally similar to the current limiting circuit 100 illustrated in FIG. 3. In FIG. 5, $V_{REF}$ designates a reference voltage at ground (GND) potential, which may be realized by a bandgap reference circuit. $V_{REF}$ is applied to the resistor R2 by the operation of the amplifier AMP 32, so that $V_{IN}-V_{R3}$ is $V_{REF}\times R1/R2$. The value of $V_{R1}$ (i.e., the value of V10) is set such that $V_{R1}$ is equal to $V_{R3}$ with reference to ground (GND) when the transistor Q33 is turned off.

When the transistor Q33 is turned on (such as by the one-shot pulse from the one-shot pulse generating circuit 130), $V_{IN}-V_{R3}$ becomes $V_{REF}\times R1/(R2//R3)$. This corresponds to the reference voltage that determines the second limit current $I_{LIM2}$ in the First and the Second Embodiments. (R2//R3) indicates the resistance when the resistors R2 and R3 are connected in parallel, whose value is (R2×R3)/(R2+R3). The output voltage $V_{OUT}$ and the output current $I_{OUT}$ transition as illustrated in FIG. 6. The waveforms are identical to those of the First Embodiment between time t0 and time t2.

When the variable-load resistor $R_L$ of the external apparatus 3*d* sharply decreases at time t2, the output current $I_{OUT}$ increases to a value I2 and the sense voltage $V_{SENS}$ sharply drops. If I2 is greater than the first limit current $I_{LIM1}$, i.e., if the sense voltage $V_{SENS}$ is lower than $V_{R1}$, the output of the amplifier AMP 33 assumes "H" level. In response, the output of the one-shot pulse generating circuit 130 rises and the transistor Q33 is turned on, whereby $V_{R3}$ is changed from a voltage corresponding to the reference voltage that determines the first limit current $I_{LIM1}$ to a voltage corresponding to the reference voltage that determines the second limit current $I_{LIM2}$.

While the output of the amplifier AMP 31 also rises simultaneously with the increase in the output current $I_{OUT}$ and the sharp decrease in the sense voltage $V_{SENS}$, $V_{R3}$ is changed (sharply decreased) to a voltage corresponding to the reference voltage that determines the second limit current $I_{LIM2}$ immediately after the start of change in the voltage $V_G$. Thus, the output of the amplifier AMP 31 falls, so that the voltage $V_G$ is hardly changed substantially.

If the output current $I_{OUT}$ decreases from I2 to I1 before the period $T_{ILIM2}$ (pulse width of one-shot pulse) elapses, the voltage $V_G$ is not changed and maintained at "H" level. When $I_{OUT}$ is at I2, the output voltage $V_{OUT}$ decreases to V2 due to a voltage drop corresponding to a sum of the on-resistance of the power MOSFET Q10 and the sense resistance times the increase in the output current $I_{OUT}$, as illustrated in FIG. 6.

Thereafter, when the switch SW 1 of the external apparatus 1*d* is turned on at time t4 and the output OUT is short-circuited to ground (GND), the output current $I_{OUT}$ exceeds the first limit current $I_{LIM1}$ and the output of the amplifier AMP 33 assumes "H" level, so that the limit current is set to the second limit current $I_{LIM2}$. While the output current $I_{OUT}$ may tend to exceed the second limit current $I_{LIM2}$, the output of the amplifier AMP 31 assumes "H" level and the transistor Q31 is turned on. Thus, the power MOSFET Q10 is feedback-controlled such that the output current $I_{OUT}$ is limited to the second limit current $I_{LIM2}$. Simultaneously, error information is sent to the host apparatus system, and a transient current $I_{TRANS}$ in excess of the second Limit current $I_{LIM2}$ flows for a very short period after time t4, as in the case of the First and the Second Embodiments.

The enable signal to the current limiting unit 3*a* is disabled at time t5 by the operation of the host apparatus system in response to the error information. As a result, the power MOSFET Q10 is turned off, and the output current $I_{OUT}$ becomes zero. Thereafter, when the switch SW 1 is turned off before time t6 and the current limiting unit 3*a* is again enabled at time t6, the transistor Q10 is turned on after time t6, so that the output voltage $V_{OUT}$ rises in the same way as after t0.

Thus, in a system where an external apparatus is supplied with electric power from a host apparatus, when the external apparatus temporarily requires a large transient current (such as I2), the current limiting circuits 100, 200, and 300 according to the foregoing embodiments of the present invention allow such transient current to flow for the period $T_{ILIM2}$. If the current (I2) flows even after the period, the output current $I_{OUT}$ is compulsorily limited to $I_{LIM1}$, thus ensuring safety. The period $T_{ILIM2}$ may be appropriately designed depending on the characteristics of the external apparatus.

One-Shot Pulse Generating Circuit

Figure 7A:
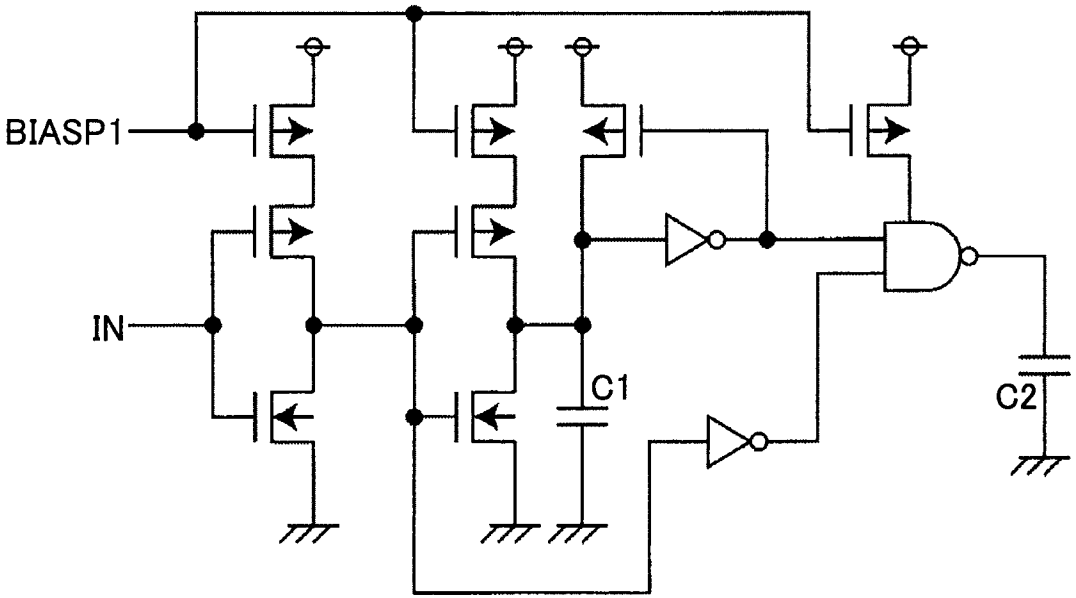
FIG. 7A is a circuit diagram of a one-shot pulse generating circuit that may be used in the current limiting circuit illustrated in FIG. 3.

The one-shot pulse generating circuit 30 or 130 may be based on conventional technologies. FIG. 7A is a circuit diagram of the one-shot pulse generating circuit 30. The one-shot pulse generating circuit 30 includes plural N-ch MOSFETs, plural P-ch MOSFETs, an inverter, a NAND circuit, a capacitor, and a power supply. A capacitor C2 is charged with a constant current determined by a bias input BIASP1. Thus, the rise time of the one-shot pulse is determined by the constant current determined by BIASP1.

Figure 7B:
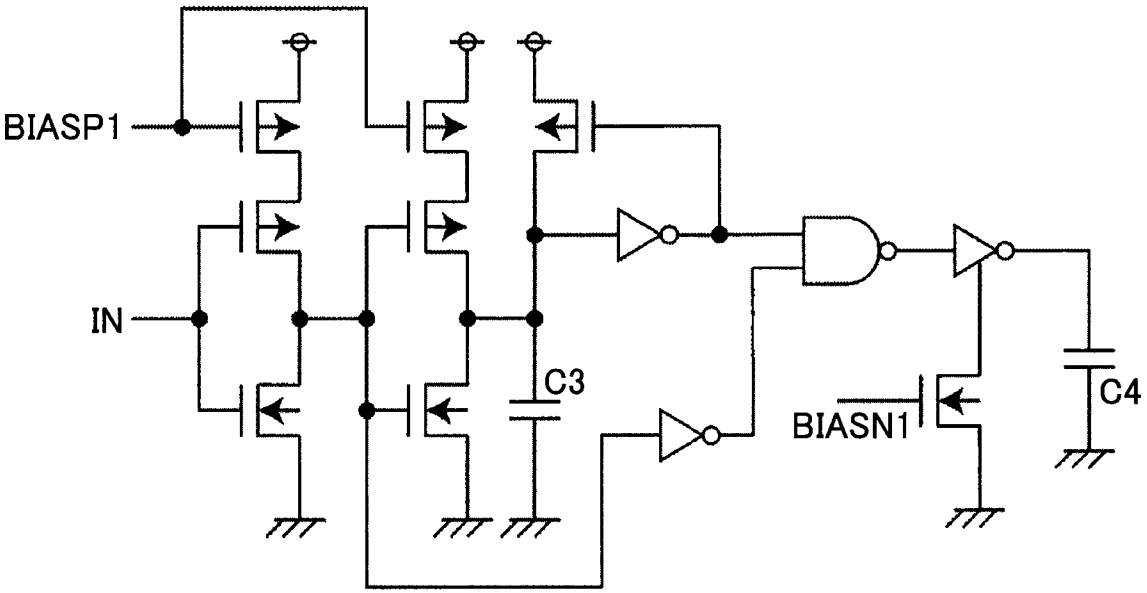
FIG. 7B is a circuit diagram of another one-shot pulse generating circuit that may be used in the current limiting circuit illustrated in FIG. 5.

Similarly, FIG. 7B is a circuit diagram of the one-shot pulse generating circuit 130. The one-shot pulse generating circuit 130 includes plural N-ch MOSFETs, plural P-ch MOSFETs, an inverter, a NAND circuit, a capacitor, and a power supply. A capacitor C4 is discharged by a constant current determined by a bias input BIASN1. Thus, the fall time of the one-shot pulse is determined by the constant current determined by BIASN1.

An embodiment of the present invention may be utilized in an over-current protection apparatus for a power MOSFET, a power switch IC, or an over-current protection circuit for an IC having a power switch. In accordance with an embodiment of the present invention, when a supply current that slightly exceeds a maximum rated current is detected in a load drive apparatus, such as a regulator or a driver circuit, that supplies a voltage to a load, the current supply is permitted if the excess current is transient and required by the external apparatus for normal operation.

Although this invention has been described in detail with reference to certain embodiments, variations and modifications exist within the scope and spirit of the invention as described and defined in the following claims.

The present application is based on Japanese Priority Application No. 2010-032631 filed Feb. 17, 2010, the entire contents of which are hereby incorporated by reference.

The invention claimed is:

1. A current limiting circuit comprising:

a current limiting unit that sets a value of a limit current for limiting an output current from a driver circuit connected to the current limiting circuit, the limit current value including a first acceptable value and a second acceptable value that is larger than the first acceptable value;

a one-shot pulse generating unit that detects when the output current from the driver circuit exceeds the first acceptable value and outputs a pulse of a predetermined duration, to cause the current limiting unit to set the limit current value to the second acceptable value when the output current is greater than the first acceptable value, wherein the current limiting unit includes a current limiting transistor, and when the output current exceeds the second acceptable value, the current limiting transistor is turned on to limit the output current to the second acceptable value.

2. A current limiting circuit comprising:

a driver circuit including a power MOSFET and a sense resistor through which a current that flows through the power MOSFET flows;

a current limiting unit including:

a first limiting circuit that detects an output current of the driver circuit by comparing a sense voltage obtained from one end of the sense resistor with a first reference voltage, and that limits the output current when the output current detected by the first limiting circuit is greater than a first current value corresponding to the first reference voltage; and a second limiting circuit that detects the output current from the driver circuit by comparing the sense voltage obtained from the one end of the sense resistor with a second reference voltage, and that limits the output current when the output current detected by the second limiting circuit is greater than a second limit current value which corresponds to the second reference voltage and is greater than the first limit current value; and a one-shot pulse generating unit that outputs a pulse of a predetermined duration, to cause the current limiting unit to limit the output current to the second limit current value, when the output current detected by the first limiting circuit is greater than the first limit current value.

3. A current limiting circuit comprising:

a driver circuit including a power MOSFET and a sense resistor through which a current that flows through the power MOSFET flows;

a current limiting unit that detects an output current of the driver circuit by comparing a sense voltage obtained from one end of the sense resistor with a first reference voltage, and that limits the output current when the detected output current is greater than a first limit current value corresponding to the first reference voltage;

a one-shot pulse generating unit that, when the value of the output current detected by the current limiting unit is greater than the first limit current value, outputs a pulse of a predetermined duration, to disable the current limiting unit and prevent the output current from being limited, and changes the first reference voltage compared with the sense voltage to a second reference voltage for the predetermined duration in order to change the first limit current value to a second limit current value corresponding to the second reference voltage, wherein the first reference voltage and the second reference voltage are set such that the second limit current value is greater than the first limit current value.

* * * * *